US007040114B2

(12) United States Patent
Lee et al.

(10) Patent No.: US 7,040,114 B2
(45) Date of Patent: May 9, 2006

(54) STORAGE UNIT

(75) Inventors: Seung Joon Lee, Anyang (KR); Seog Guen Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 34 days.

(21) Appl. No.: 10/781,753

(22) Filed: Feb. 20, 2004

(65) Prior Publication Data

US 2005/0022547 A1 Feb. 3, 2005

(30) Foreign Application Priority Data

Jul. 31, 2003 (KR) ..... 10-2003-0053169

(51) Int. Cl.
*F25D 11/02* (2006.01)

(52) U.S. Cl. ..... 62/443; 312/287; 312/405

(58) Field of Classification Search ..... 312/287–290, 312/404, 405; 62/441–446
See application file for complete search history.

(56) References Cited

U.S. PATENT DOCUMENTS 2,161,297 A * 6/1939 Hull ..... 62/449
2,189,389 A * 2/1940 Baker ..... 220/345.5
2,584,886 A * 2/1952 Laguzzi ..... 312/405
2,811,405 A * 10/1957 Formoso ..... 312/287
3,086,830 A * 4/1963 Malia ..... 312/200
3,153,918 A * 10/1964 Fink et al. ..... 62/297
3,367,061 A * 2/1968 Primmer et al. ..... 43/55
5,388,427 A 2/1995 Lee ..... 62/331
6,220,049 B1 * 4/2001 Lajeunesse ..... 62/440
6,415,552 B1 * 7/2002 Khosropour ..... 52/27
6,484,531 B1 * 11/2002 Hambleton et al. ..... 62/440

* cited by examiner

*Primary Examiner*—William E. Tapolcai
(74) *Attorney, Agent, or Firm*—Staas & Halsey LLP

(57) ABSTRACT

A storage unit having at least one storage compartment, to store various food and beverage at respective optimum temperatures, and to allow various food and beverage to be conveniently stored in and removed from the at least one storage compartment. The storage unit has a cabinet with at least one storage compartment, a first door to close a first side of the at least one the storage compartment, and a second door to close a second side of the at least one storage compartment. A table is slidably placed on a first surface of the cabinet. The cabinet has a storage recess positioned on the first surface thereof. The storage recess is selectively exposed and shielded by the table sliding on the cabinet. The storage recess is maintained at low temperatures by a refrigerant pipe positioned adjacent to the storage recess.

12 Claims, 5 Drawing Sheets

STORAGE UNIT

CROSS-REFERENCE TO RELATED APPLICATIONS

This application claims the benefit of Korean Application No. 2003-53169, filed Jul. 31, 2003, in the Korean Intellectual Property Office, the disclosure of which is incorporated herein by reference.

BACKGROUND OF THE INVENTION

1. Field of the Invention

The present invention relates to a storage unit, and, more particularly, to a storage unit having storage compartments, which allow food to be received in and taken out of the compartments through a rear face thereof as well as a front face thereof, and which includes a top table slidably placed on a top surface of a cabinet thereof, to allow containers, such as bottles and cups, containing wine, beverage, etc., to be placed thereon, thus enabling a user to conveniently locate the wine, beverage, etc.

2. Description of the Related Art

Generally, a conventional refrigerator, which is adapted to be used in a home, is fixedly installed at a location near to a kitchen or another proper location, to freshly store refrigerated and frozen food. The conventional refrigerator includes a cabinet, vertically elongated, with a pair of doors hingedly coupled to a front face of the cabinet to open and close storage compartments defined in the cabinet, thereby allowing food to be received in the storage compartments.

Since the refrigerator is manufactured to have a large internal volume capable of storing a large amount of food all at once, the refrigerator has a considerable weight. Therefore, it is difficult to relocate the refrigerator after installation. Additionally, the refrigerator has a high electric power consumption, and thus is costly to operate.

Since a refrigerator is manufactured to store more various food therein, to add variety to what a user consumes, it may be very inconvenient to take out a desired food of the refrigerator, and it is impossible to store various food in respective storage temperatures. Accordingly, to store various food, such as Kimchi and wine, in respective optimum conditions, separate storage units have to be used.

In addition, since most people have busy daily lives, the user usually stores various instant food and cooked food in a refrigerator, to reduce a time to prepare food. Accordingly, since a large amount of food is closely contained in storage compartments of the refrigerator, it is more difficult to conveniently and quickly put a desired food in the refrigerator and take a desired food out of the refrigerator.

Generally, food and beverage, such as Kimchi, beer, and wine, which are commonly enjoyed by a user at a mealtime and other times, are frequently removed from the refrigerator. However, since the conventional refrigerator is fixedly installed at a specific location, and constructed to allow food to be put in and taken from only one side thereof, it is inconvenient to use the refrigerator. Furthermore, since leakage of cool air in the refrigerator is increased due to the frequent opening and closing operations of a door, electric power consumption is inevitably increased, to maintain a temperature in the refrigerator at a predetermined temperature.

In particular, the conventional refrigerator is inadequate to permit a user to instantly take out food, such as wine, which has to be separately stored in a specific storage temperature. In addition, when such favorite food is stored together with another type of food, it is impossible to maintain the inherent and pleasant taste of the favorite food, and it is inconvenient to put food in the refrigerator and to take out food of the refrigerator.

More specifically, beverages, such as wine, can conserve the quality when the wine is stored within a temperature range of 11° C. to 17° C. Accordingly, when wine is stored together with another type of food or beverage in the conventional refrigerator, it is impossible not only to store only the wine in a separate specific temperature, but also to extemporarily take out the wine from the refrigerator while using a top surface of the refrigerator as a table.

SUMMARY OF THE INVENTION

Accordingly, it is an aspect of the present invention to provide a storage unit, which is provided with a plurality of storage compartments, to enable specific types of food and beverage, which are frequently taken out of the storage unit and served to a user, to be independently maintained at optimum temperatures.

It is another aspect of the present invention to provide a storage unit, which is constructed to allow specific food stored therein to be taken out of the storage unit through a rear side as well as a front side of the storage unit, to enhance convenience in use.

It is a further aspect of the present invention to provide a storage unit, which is provided at a top surface thereof with a cold storage recess to maintain food at low temperatures, and a top table slidably placed on the top surface, to allow selected food to be taken out of the cold storage recess extemporarily.

Additional aspects and/or advantages of the invention will be set forth in part in the description which follows and, in part, will be obvious from the description, or may be learned by practice of the invention.

The above and/or other aspects are achieved by providing a refrigerated storage unit having a cabinet including a storage compartment therein, a first door to open and close a first side of the storage compartment, and a second door to open and close a second side of the storage compartment.

According to one aspect, the first side of the storage compartment is a front side of the storage compartment, and the second side of the storage compartment is a rear side of the storage compartment.

The above and/or other aspects are achieved by providing a refrigerated storage unit including a cabinet having a storage compartment therein, and a table slidably placed on a first surface of the cabinet.

According to one aspect, the storage unit has a storage recess positioned on the first surface of the cabinet. The storage recess is selectively exposed and shielded by the table sliding on the cabinet.

According to one aspect, the storage recess is maintained at a predetermined temperature by a refrigerant pipe positioned adjacent to the storage recess.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
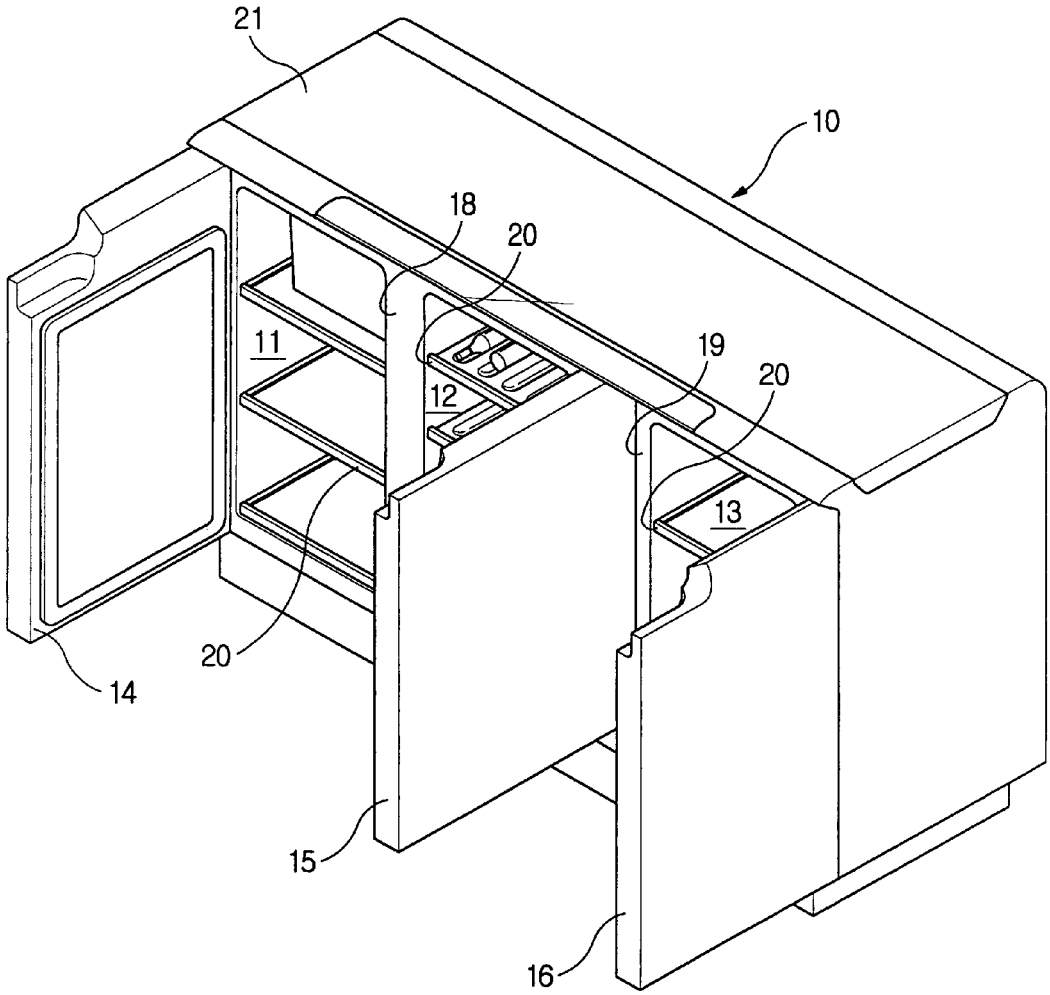
FIG. 1 is a front perspective view of a storage unit according to an embodiment of present invention.

Reference will now be made in detail to an embodiment of the present invention, an example of which is illustrated in the accompanying drawings, wherein like reference numerals refer to like elements throughout. The embodiment is described to explain the present invention by referring to the figures.

FIG. 1 is a perspective view of a storage unit, according to an embodiment of the present invention. As shown in FIG. 1, the storage unit includes a general box-shaped cabinet 10 having inner space therein, and first to third storage compartments 11 to 13 laterally defined in the inner space by a pair of partition walls 18 and 19, to separately store various food and beverage therein.

The cabinet 10 includes first to third front doors 14 to 16 hingedly coupled to a front face of the cabinet 10 to close the corresponding first to third storage compartments 11 to 13.

The first to third storage compartments 11 to 13 are designed to be controlled to maintain respective specified temperatures, to separately store various types of food at respective optimum conditions.

For example, according to one aspect, the first storage compartment 11 is maintained at a temperature adequate to store Kimchi, which is commonly served at a mealtime, at an optimum Kimchi storage condition, thus serving as a Kimchi storage compartment. The second storage compartment 12 is maintained at a temperature adequate to store wine at an optimum wine storage condition, thus serving as a wine storage compartment. And the third storage compartment 13 is maintained at a temperature adequate to store general refrigerated food and beverage, such as drinking water, beer, and appetizers, which are frequently served at home, thus serving as a general food storage compartment.

As such, the first to third storage compartments 11 to 13 of the storage unit are controlled to separately store Kimchi, wine, and general food, which are frequently served at home, in respective optimum temperatures, thereby enabling the storage unit to be conveniently used at home. The first to third storage compartments 11 to 13 are provided with a plurality of shelves 20, respectively, which are vertically spaced apart from each other, to efficiently store a large amount of food.

To maintain the first to third storage compartments 11 to 13 in respective specific temperatures, refrigerant pipes (not shown) are embedded in upper and lower walls and side walls of the first to third storage compartments 11 to 13. Consequently, the internal spaces in the first to third storage compartments 11 to 13 are directly cooled by the refrigerant pipes, and thus, are quickly cooled to respective predetermined temperatures, and maintained at the respective temperatures. To this end, according to one aspect, the cabinet 10 includes a machine room (not shown) disposed in the rear of the third storage compartment 13, to house electrical components, such as a compressor and a condenser.

The storage unit is not installed on an indoor wall surface, but rather, is installed in an open space between a kitchen and a living room, to enhance accessibility to the storage unit. For the purpose of accessibility, at least one of the first to third storage compartments is additionally provided with a rear door.

Figure 2:
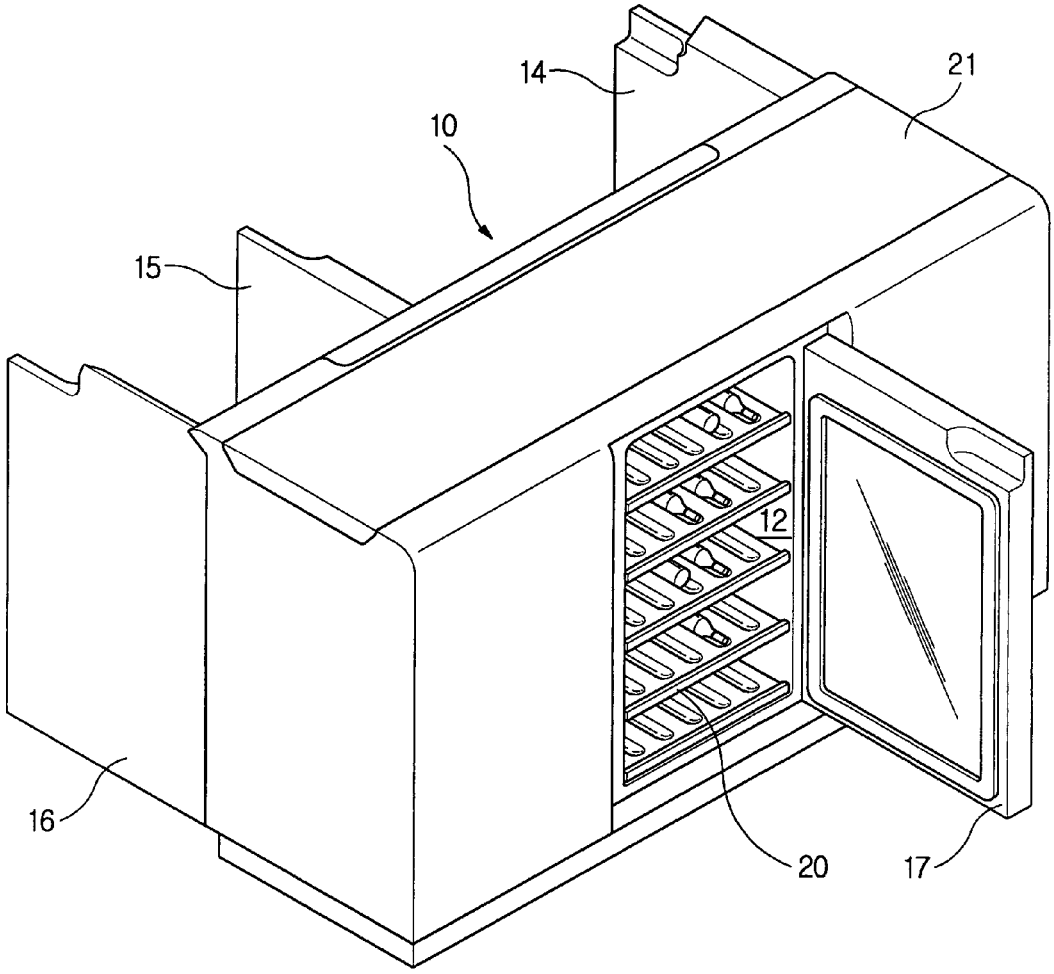
FIG. 2 is a rear perspective view of the storage unit of FIG. 1.

That is, as illustrated in FIG. 2, which shows a rear surface of the storage unit, by providing a specific compartment with the rear door as well as the front door, a user can put food in the specific storage compartment, and remove the food from the specific storage compartment from both the front and the rear of the storage unit.

According to one aspect, the second storage compartment 12 includes the rear door 17 hingedly coupled to a rear surface of the storage unit. A user can approach the second storage compartment 12 from either a kitchen 1, or a living room 2 (see FIG. 5), and then can conveniently take out a desired item, such as wine, from the second storage compartment 12.

According to one aspect, the first to third storage compartments 11 to 13 are all provided with respective corresponding rear doors (not shown). A user can approach any of the storage compartments 11 to 13 from either the front or the rear of the storage unit, and then can conveniently take out the desired food from any of the first to third storage compartments 11 to 13.

According to one aspect, the storage unit also serves as a cocktail bar, to enable a user to take food and beverage out of the storage compartments, and to enjoy them extemporarily. This aspect of the storage unit will now be described with reference to FIGS. 3 and 4.

Figure 3:
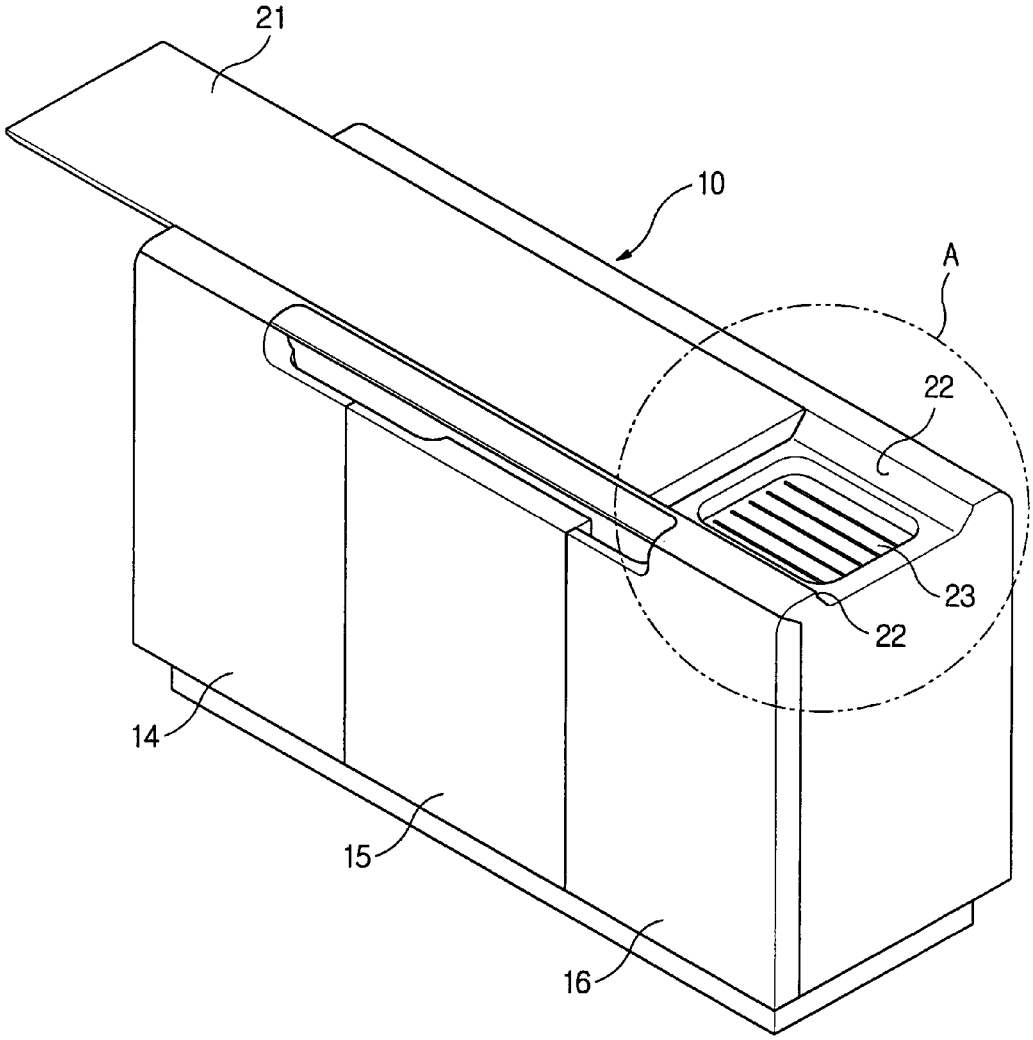
FIG. 3 is a front perspective view of the storage unit of FIG. 1.
Figure 4:
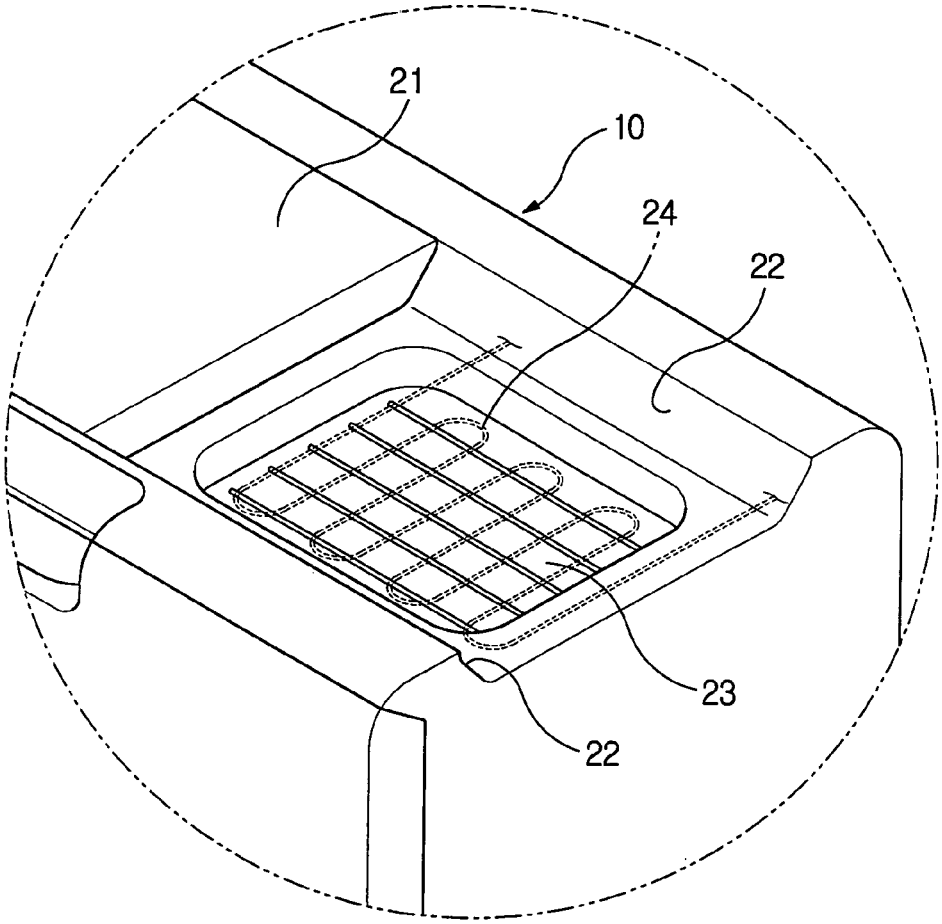
FIG. 4 is an enlarged view of a circle portion A of FIG. 4.

FIG. 3 shows the storage unit including a top table 21 slidably disposed on a top of the storage unit, which is moved from the normal position. And FIG. 4 is an enlarged view of a circle portion A of FIG. 3, which shows a configuration to maintain a cold storage recess, provided on a top of the cabinet, at low temperatures.

As shown in FIG. 3, the top table 21 is disposed on the top of the cabinet 10, such that the top table 21 slides laterally along front and rear inclined surfaces 22 positioned, respectively, at the front and rear of the top of the cabinet. The cabinet 10 includes a cold storage recess 23 positioned on a first end (a right end of FIG. 3) of the top of the cabinet 10, to allow food and beverage taken out of the storage compartments to conveniently be placed in the cold storage recess 23.

Accordingly, when the top table 21 is moved toward a second end, opposite the first end (a left end of FIG. 3) of the top of the cabinet 10, the top table 21 moves a predetermined distance while being guided by the inclined surfaces 22 of the cabinet 10. The sliding movement of the top table 21 exposes the cold storage recess.

Accordingly, a user can conveniently place food and beverage, taken out of the first to third storage compartments 11 to 13, on the top table 21 or in the cold storage recess 23, and can enjoy them.

As shown in FIG. 4, the cold storage recess 23 includes a refrigerant pipe 24 embedded in a bottom thereof, which extends in a zigzag fashion, to maintain a surface of the cold storage recess 23 at a low temperatures. Consequently, beverage such as wine, beer and drinking water, placed on the surface of the cold storage recess 23 stays cold, thus more efficiently satisfying the user's thirst.

When the top table 21 is moved toward the first end of the top of the cabinet, after the beverage cooled by the cold storage recess 23 is consumed, the top table 21 slides along the inclined surfaces 22, and thus coincides with a top surface of the cabinet 10, thereby shielding the cold storage recess 23 from the outside, as shown in FIG. 1.

Figure 5:
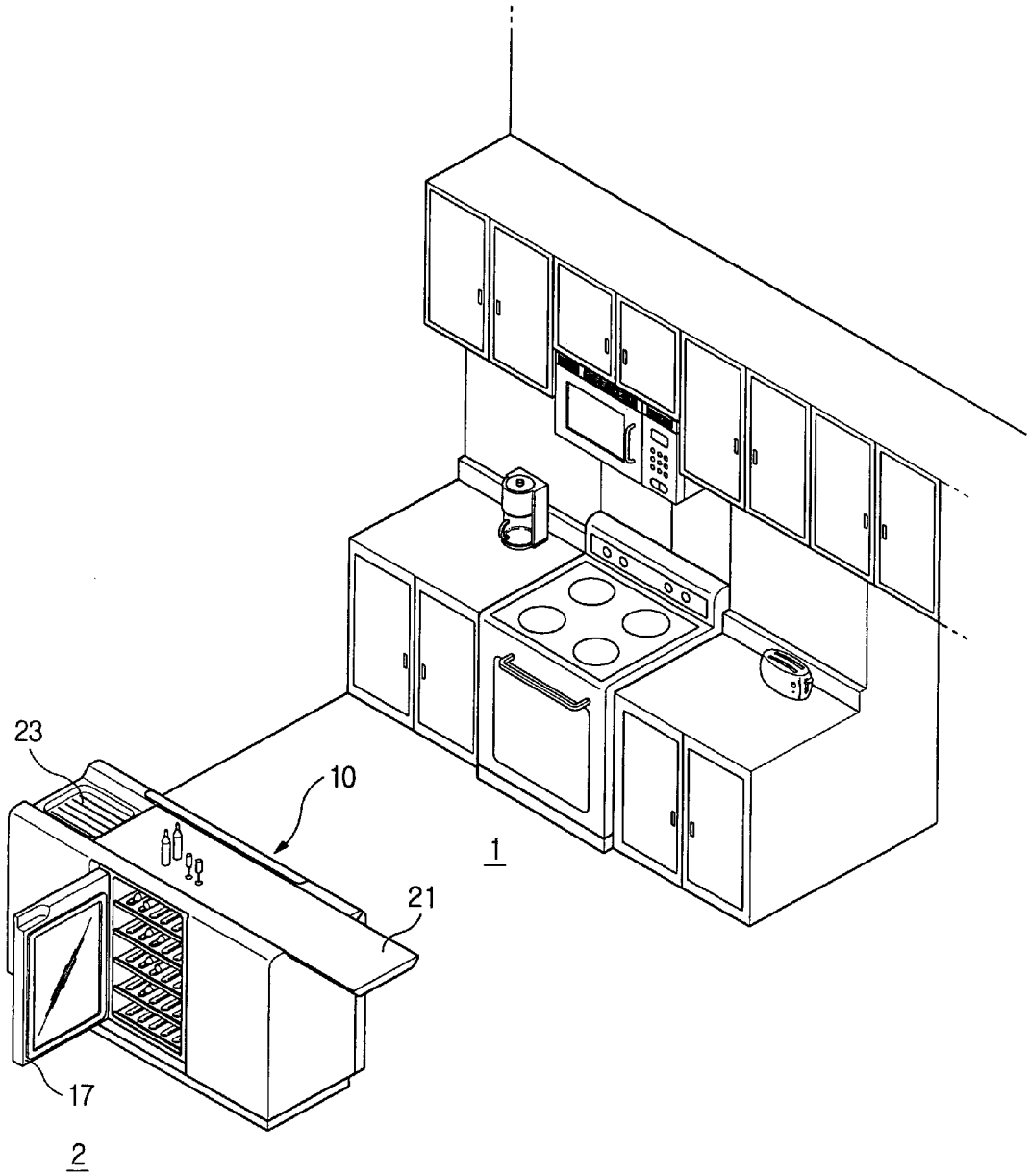
FIG. 5 is a perspective view of the storage unit, which is installed between a kitchen and a living room.

FIG. 5 is a perspective view showing the storage unit installed between the kitchen 1 and the living room 2. As shown in FIG. 5, the cabinet 10 includes the first to third front doors 14 to 16 at a front face thereof, and includes the rear door 17 at a rear face thereof. The storage unit is orientated such that the front of the cabinet 10 faces the kitchen 1 and the rear of the cabinet 10 faces the living room 2. Accordingly, a user can put food and beverage in the storage unit, and can remove the food and beverage from the storage unit from both the front and rear of the storage unit.

When the top table 21, is pushed, exposing the cold storage recess 23, beverage, such as wine and beer, and appetizers can be placed on the surface of the cold storage recess 23, and cooled by the cold storage recess 23. Therefore, a user can conveniently enjoy the cold beverage and appetizer placed on the storage unit.

As apparent from the above description, the present invention provides a storage unit, which includes a plurality of storage compartments to store various foods and beverages at respective optimum temperatures. Accordingly, various foods and beverages, which are frequently served at home, can be separately stored under their respective optimum conditions.

Since the storage unit enables food and beverage to be put therein, and to be removed from the rear, as well as the front of the cabinet, it is possible to have access to the storage unit from both the kitchen 1 and living room 2.

In addition, since the storage unit includes the cold storage recess 23 and the slidable top table 21 on the top of the cabinet 10, and food and beverage, stored in the storage compartments of the storage unit, can be conveniently taken out of the storage compartments and then placed on the surface of the cold storage recess 23, the storage unit may serve as a cocktail bar in a private home.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A refrigerated storage unit comprising:

a cabinet having a storage compartment therein;

a first door to open and close a first side of the storage compartment;

a second door to open and close a second side of the storage compartment;

a table, slidably positioned on a top surface of the cabinet; and a storage recess, recessed from the top surface of the cabinet, selectively exposed by sliding of the table, and having a refrigerant pipe embedded in a bottom thereof.

2. The storage unit as set forth in claim 1, wherein the first side of the storage compartment is a front side of the storage compartment, and the second side of the storage compartment is a rear side of the storage compartment.

3. An apparatus, comprising:

a cabinet having at least one refrigerated compartment with first and second openings;

a first door selectively opening and closing the first opening of the refrigerated compartment; and a second door selectively opening and closing the second opening of the refrigerated compartment a table, slidably positioned on a top surface of the cabinet; and a storage recess, recessed from the top surface of the cabinet, selectively exposed by sliding of the table, and having a refrigerant pipe embedded in a bottom thereof.

4. The apparatus according to claim 3, wherein:

the first opening is opposite to the second opening.

5. The apparatus according to claim 3, wherein the at least one refrigerated compartment comprises:

a plurality of refrigerated compartments, each compartment having a separate temperature control.

6. The apparatus according to claim 3, wherein:

the table comprises inclined surfaces at edges thereof;

the cabinet further comprises mating inclined surfaces corresponding to the inclined surfaces of the table; and the inclined surfaces slidingly contact the mating inclined surfaces to move the table.

7. A refrigerator, comprising:

a cabinet having a plurality of refrigerated compartments, each compartment having a first door selectively opening and closing a first opening thereof, and a separate temperature control;

a table, slidably positioned on a top surface of the cabinet; and a storage recess, recessed from the top surface of the cabinet, selectively exposed by sliding of the table, and having a refrigerant pipe embedded in a bottom thereof, wherein at least one of the plurality of refrigerated compartments has a second door selectively opening and closing a second opening thereof.

8. The refrigerator according to claim 7, wherein:

the second opening is opposite to the corresponding first opening.

9. The refrigerator according to claim 7, wherein:

the table comprises inclined surfaces at edges thereof;

the cabinet further comprises mating inclined surfaces corresponding to the inclined surfaces of the table; and the inclined surfaces slidingly contact the mating inclined surfaces to move the table.

10. An apparatus, comprising:

a cabinet having at least one refrigerated compartment with first and second openings;

a first door selectively opening and closing the first opening of the refrigerated compartment;

a second door selectively opening and closing the second opening of the refrigerated compartment;

a refrigerated storage recess recessed from a top surface of the cabinet and having a refrigerant pipe embedded in a bottom thereof; and a table, slidably positioned on the top surface of the cabinet, to selectively expose and cover the refrigerated storage recess.

11. The apparatus according to claim 10, wherein:

the first opening is opposite to the second opening.

12. An apparatus, comprising:

a container having at least one refrigerated compartment;

a first door selectively opening and closing a first opening of the at least one compartment, positioned on a first face of the container; and a second door selectively opening and closing a second opening of the at least one compartment, positioned on a second face of the container a table, slidably positioned on a top surface of the container; and a storage recess, recessed from the top surface of the container, selectively exposed by sliding of the table, and having a refrigerant pipe embedded in a bottom thereof, wherein the second face is opposite to the first face.

* * * * *